US010906569B2

(12) United States Patent
Schmidt

(10) Patent No.: US 10,906,569 B2
(45) Date of Patent: Feb. 2, 2021

(54) RAIL VEHICLE HAVING A COUPLING ARRANGED IN THE FRONT REGION THEREOF

(71) Applicant: SIEMENS MOBILITY GMBH, Munich (DE)

(72) Inventor: Gerhard Schmidt, Essen (DE)

(73) Assignee: Siemens Mobility GmbH, Munich (DE)

( * ) Notice: Subject to any disclaimer, the term of this patent is extended or adjusted under 35 U.S.C. 154(b) by 648 days.

(21) Appl. No.: 15/503,454

(22) PCT Filed: Aug. 10, 2015

(86) PCT No.: PCT/EP2015/068337
§ 371 (c)(1),
(2) Date: Feb. 13, 2017

(87) PCT Pub. No.: WO2016/023851
PCT Pub. Date: Feb. 18, 2016

(65) Prior Publication Data

US 2017/0232980 A1 Aug. 17, 2017

(30) Foreign Application Priority Data

Aug. 13, 2014 (DE) ..... 10 2014 216 061

(51) Int. Cl.
*B61G 11/16* (2006.01)
*B61G 7/10* (2006.01)
*B61G 11/14* (2006.01)

(52) U.S. Cl.
CPC ..... *B61G 11/16* (2013.01); *B61G 7/10* (2013.01); *B61G 11/14* (2013.01)

(58) Field of Classification Search
CPC ..... B61G 11/16; B61G 7/10; B61G 11/14
See application file for complete search history.

(56) References Cited

U.S. PATENT DOCUMENTS 7,735,427 B2 * 6/2010 Gansweidt ..... B61G 7/10 105/392.5
8,328,030 B2 12/2012 Kontetzki
2009/0039044 A1 * 2/2009 Krause ..... B61G 9/24 213/64

(Continued)

FOREIGN PATENT DOCUMENTS

EP 2188165 B1 11/2011
EP 2687416 A1 1/2014

(Continued)

OTHER PUBLICATIONS

Frontsystern Talgo 250, Spanien; http://www.voith.com/de/produkte-leistungen/antriebstechnik/scharfenberg-frontsysteme/frontsystem-talgo-250-26271.html.

*Primary Examiner* — Scott A Browne
(74) *Attorney, Agent, or Firm* — Laurence Greenberg; Werner Stemer; Ralph Locher

(57) ABSTRACT

A rail vehicle includes a coupling disposed centrally in a front region of the rail vehicle. The coupling is mounted in a transversely extended crossmember, so that forces acting on the coupling are introduced through the crossmember into abutments which are supported on a front side of a car body of the rail vehicle. The crossmember is connected through at least one elastic energy absorption configuration to one of the abutments.

12 Claims, 4 Drawing Sheets

(56) References Cited

U.S. PATENT DOCUMENTS

| | | | | |
|---|---|---|---|---|
| 2009/0151595 | A1* | 6/2009 | Kontetzki | B61G 9/06 105/8.1 |
| 2010/0064931 | A1* | 3/2010 | Heinisch | B61D 17/06 105/392.5 |
| 2012/0031299 | A1* | 2/2012 | Kontetzki | B60R 19/34 105/392.5 |
| 2012/0199545 | A1* | 8/2012 | Peckham | B61G 9/10 213/65 |

FOREIGN PATENT DOCUMENTS

| | | | |
|---|---|---|---|
| EP | 2601088 | B1 | 7/2014 |
| KR | 20100117018 | A | 11/2010 |

* cited by examiner

RAIL VEHICLE HAVING A COUPLING ARRANGED IN THE FRONT REGION THEREOF

BACKGROUND OF THE INVENTION

Field of the Invention

The invention relates to a rail vehicle having a coupling which is arranged centrally in the region of its front and is mounted in a transversely running crossmember, wherein forces acting on the coupling are introduced, via the crossmember, into abutments which are supported on a front side of a body of the rail vehicle.

Such a rail vehicle is, for example, the "Talgo 250", which is operated by the Spanish company RENFE. The transversely arranged crossmember interacts with energy-absorption elements arranged behind it. This arrangement for a front system of a rail vehicle means that the dimensional accuracy of an undercarriage of the rail vehicle, the energy absorbers used and the crossmember have to meet stringent requirements, since these components, overall, form a screw-connected composite arrangement which has to transmit the coupling forces which occur during operation of the rail vehicle. Any skewed positioning between the components would result in flanges not meeting, which is inadmissible in particular for dynamically loaded screw connections.

This known solution is based on the fundamental problem, in particular in the case of automatic central buffer couplings with energy-absorption elements arranged behind the point of rotation of the coupling rod, of the overall lengths of the couplings being large. An amount of displacement travel here which can be used for absorbing energy for collisions is small. The solution available from Voith for the front system of the "Talgo 250" provides a larger useful amount of displacement travel insofar as a coupling head of the central buffer coupling can be moved to a greater extent horizontally in the inward direction of the rail vehicle. Other known solutions have the disadvantage that the amount of displacement travel which can be used for the energy absorption is limited to a distance between the coupling head and the undercarriage since, in the case of these constructions, an opening in an energy-absorption apparatus provided does not leave sufficient space in order for the coupling head to penetrate therein to the full extent.

SUMMARY OF THE INVENTION

Proceeding from this, the object of the invention is for a rail vehicle of the type mentioned in the introduction to be developed further such that the requirements which have to be met by dimensional accuracy of the components involved in mounting the coupling are reduced.

This object is achieved in that the crossmember is connected to an abutment via at least one elastic energy-absorption arrangement.

In the case of this solution, in particular tensile and/or compressive forces acting on the coupling are introduced into the abutments provided via a coupling rod provided, the crossmember and the elastic energy-absorption elements. It is thus possible for the structural unit made up of the crossmember and coupling to be tilted to a certain extent in relation to a front of the rail vehicle and the abutments via the elastic energy-absorption elements, without this adversely affecting the introduction of force into the front of the vehicle.

The energy-absorption arrangement may have elastic energy-absorption elements which are arranged, and designed, in part for tensile stressing, and in part for compressive stressing, of the coupling. This means that energy absorption takes place both in the case of compressive stressing and in the case of tensile stressing of the coupling.

Two elastic energy-absorption arrangements may be arranged, as seen in the transverse direction of the rail vehicle, each on one side, in a state in which they are offset horizontally in relation to the coupling. This gives rise to appropriate installation of the structural unit made up of the coupling and crossmember on the abutments provided, with the requirements which have to be met by the dimensional accuracy of said components being less stringent.

The elastic energy-absorption elements are preferably each arranged on a connecting rod which runs horizontally in the longitudinal direction of the rail vehicle and is fixed to an associated abutment, wherein the connecting rod passes through an opening in a retaining portion of the crossmember and the elastic energy-absorption elements are designed for lateral abutment against the retaining portion.

The energy-absorption elements provided are therefore fitted onto the connecting rod, which is fastened on sides of the associated abutment, it being possible for one or more elastic energy-absorption elements to be provided, as seen in the longitudinal direction of the rail vehicle, both in front of and behind the retaining portion of the crossmember. The energy-absorption elements provided on the connecting rod can be secured in a suitable manner at the free end of the connecting rod, which is directed outward, as seen in relation to the rail vehicle. The crossmember can be guided vertically and/or laterally in relation to the abutments preferably via the connecting rods. This concerns guidance of the crossmember predominantly in a region to the inside of a coupling head, i.e. level with the connecting rods. As an alternative, or in addition, the crossmember can be guided vertically and/or laterally in relation to the abutments via separate guide elements.

It is advantageously possible for the crossmember to have its inward end portion, as seen in relation to the rail vehicle, guided on a front of the rail vehicle, or of the body thereof, via stops. Such stops will be located in a region in which the coupling rod has its inward end articulated in a bearing, in particular a spherical bearing.

For the purpose of absorbing collision energy, the abutments may be designed in the form of specifically deformable crumple elements, in which case they make a considerable contribution to absorbing energy in the event of a crash. In order for it to be possible for the abutments to be easily interchanged again following a crash, the abutments can be fastened in an interchangeable manner on a front of the rail vehicle via a releasable connection.

It is also possible for the front of the rail vehicle itself, for the purpose of absorbing collision energy, to be designed in the form of a specifically deformable crumple zone. It is likewise possible for the front of the rail vehicle to be fastened in a releasable manner on the body of the rail vehicle.

It is likewise possible, for the purpose of absorbing energy in the event of a crash, for further elements for reversible or irreversible energy absorption or force-limiting purposes to be provided in a coupling rod of the coupling. In addition, further elements for reversible or irreversible energy absorption or force-limiting purposes may be provided between the coupling rod of the coupling and the crossmember.

It is preferred to provide an anti-climbing device, which is then arranged, and fastened, on the crossmember above the coupling. Such an anti-climbing device may have horizontally running ribs.

BRIEF DESCRIPTION OF THE SEVERAL VIEWS OF THE DRAWING

An exemplary embodiment of the invention will be explained in yet more detail hereinbelow with reference to the drawings, in which.

DESCRIPTION OF THE INVENTION

Figure 1:
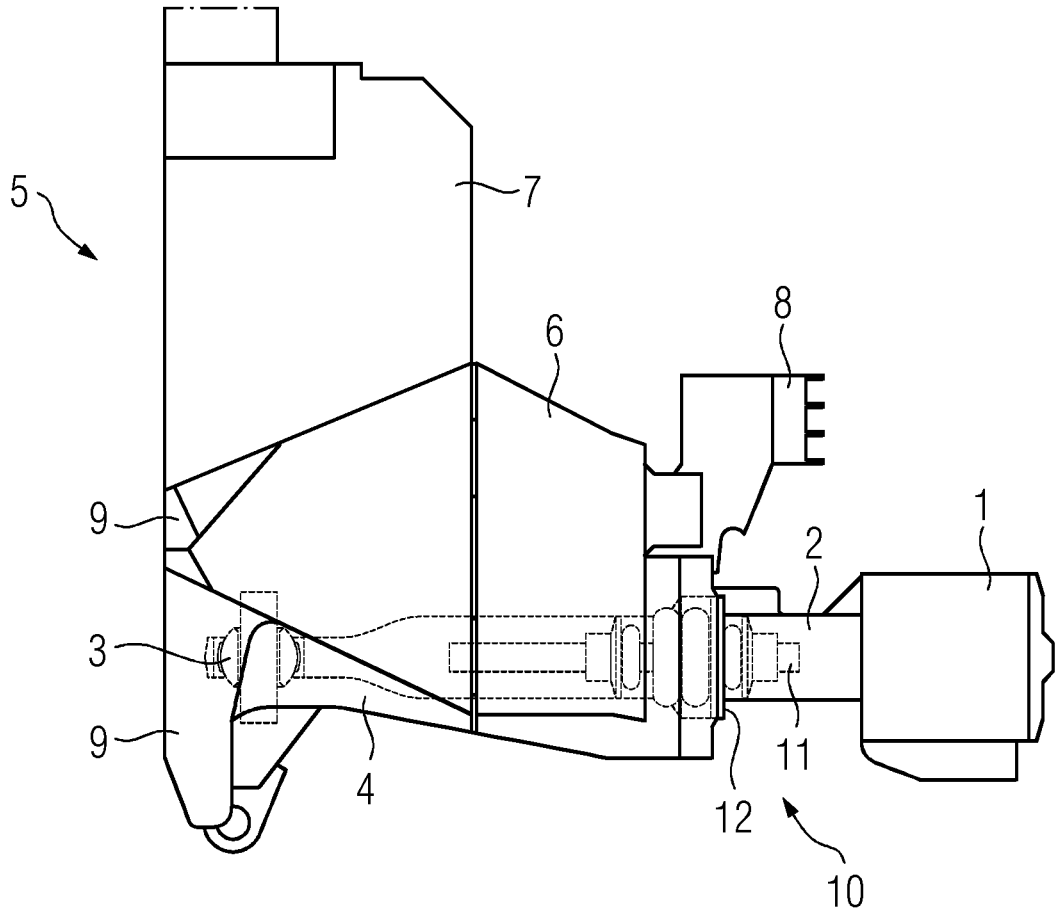
FIG. 1 shows a vertical cross-sectional view of a coupling region of a rail vehicle taken along plane A-A from FIG. 2.

As can be gathered from FIG. 1, a central buffer coupling having a coupling head 1 and a coupling rod 2, which bears the coupling head 1, is mounted in a spherical bearing 3 with a vertically running pivot axis. The spherical bearing 3, which has energy-absorption elements, is supported on a crossmember 4, which runs transversely in the front region of the rail vehicle. The crossmember 4 is arranged in an opening in the front of the rail vehicle and extends horizontally from a body 5 of the rail vehicle along a front 6, which is fitted on the body 5 of the rail vehicle, and continues along an abutment 7, from which the crossmember 4 projects in the outward direction. Both the front 6 of the rail vehicle and the abutment 7, for the purpose of absorbing collision energy, are designed in the form of a specifically deformable crumple zone. In addition, the front 6 is fastened in a releasable manner on the body 5 of the rail vehicle. Provision is likewise made for the abutment 7 to be fastened in a releasable manner on the front 6 of the rail vehicle.

An anti-climbing device 8 is provided on the upper, front portion of the crossmember 4, and forms a structural unit with the crossmember 4.

Figure 2:
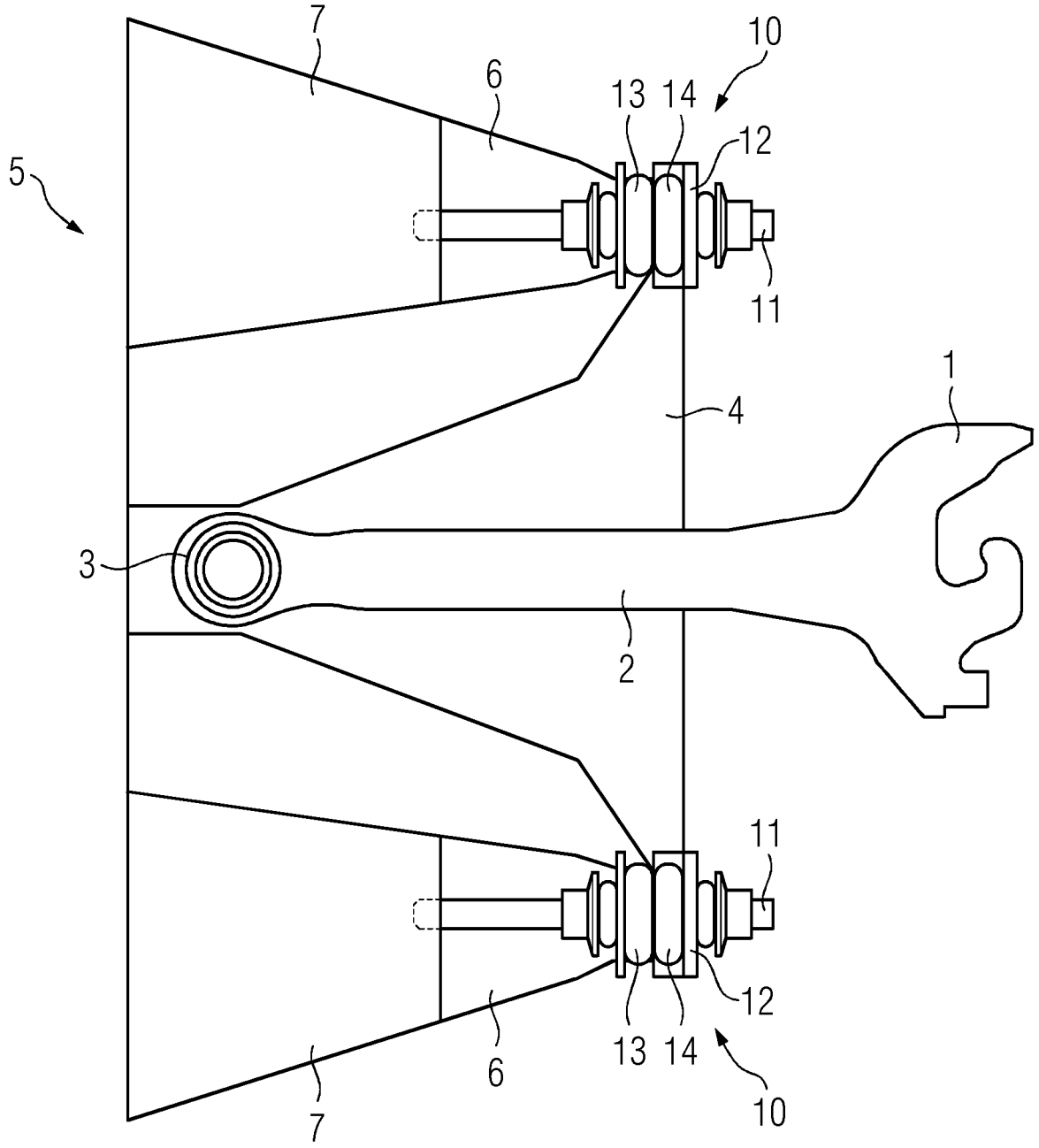
FIG. 2 shows a horizontal cross-sectional view of the coupling region of a rail vehicle from FIG. 1 taken along plane E-E from FIG. 1.
Figure 4:
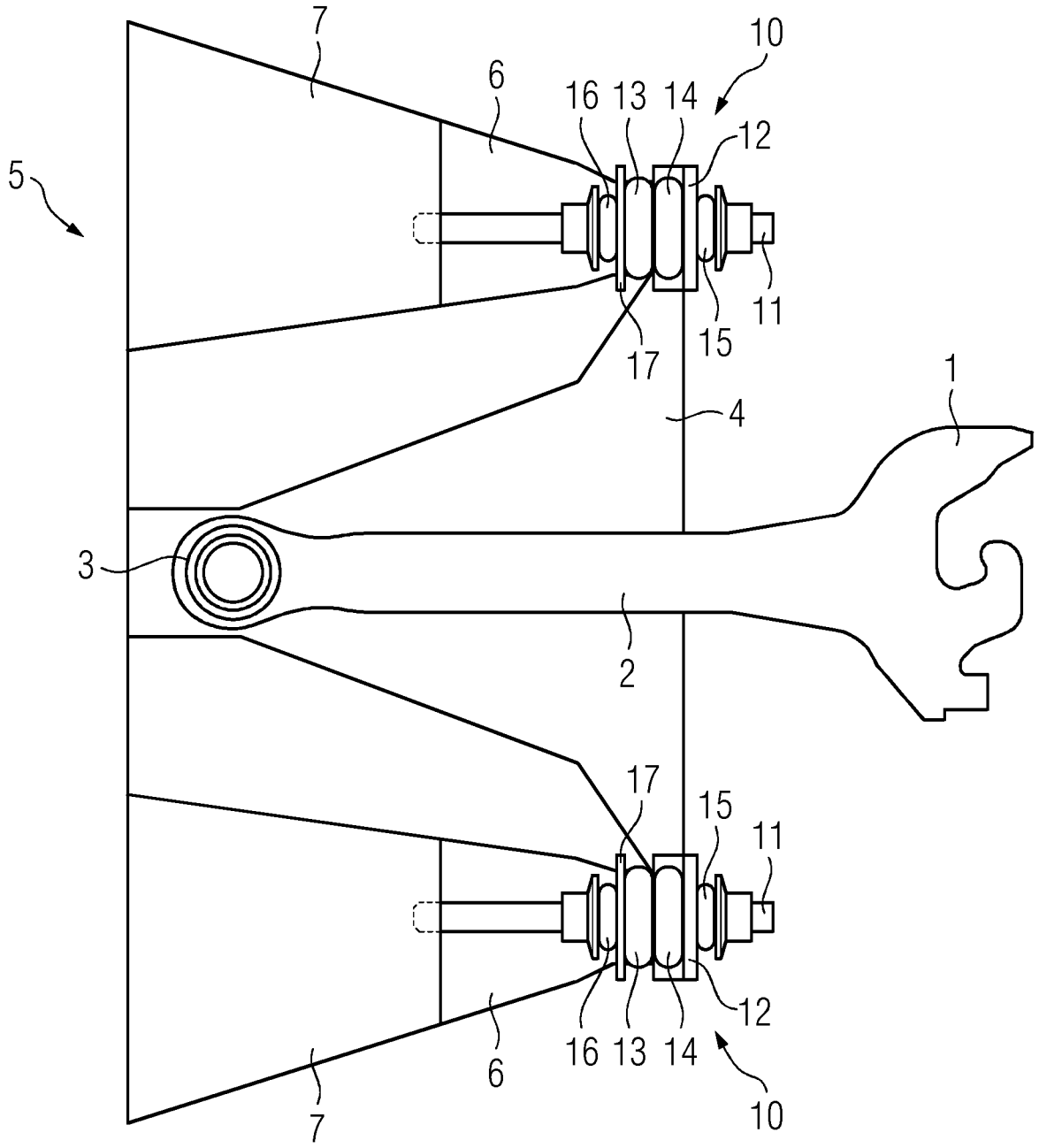
FIG. 4 shows a horizontal cross-sectional view of the coupling region of a rail vehicle from FIG. 1.

FIG. 2, then, shows, rather more in detail, the introduction into the body 5 of the rail vehicle of a longitudinal force which acts on the coupling head 1. Such longitudinal forces, which may be tensile or compressive forces, are transmitted in the first instance from the coupling head 1, via the coupling rod 2, which may itself be equipped with energy-absorption elements, to the spherical bearing 3 and thus to the crossmember 4, which runs horizontally in the transverse direction of the rail vehicle. The crossmember 4 has its inward end guided horizontally with the aid of stops 9. Guidance of the crossmember 4 is supplemented by an energy-absorption arrangement 10, which is designed in a number of parts. The energy-absorption arrangement 10 has, as its central element, a connecting rod 11, which in the present exemplary embodiment is screwed into the abutment 7 (not shown). Proceeding from the crossmember 4 is a retaining portion 12, which extends horizontally in the lateral direction and is found in the form of a metal sheet. The retaining portion 12 has a through-bore, through which the connecting rod 11 extends. The retaining portion 12 and the abutment 7 have arranged between them, in the present exemplary embodiment, two energy-absorption elements 13, 14, which are designed in the form of spring assemblies and are pushed together when the coupling is subjected to compressive stressing. Located on the opposite side of the retaining portion 12 is an energy-absorption element 15, which ensures elastic mounting of the crossmember 4 in relation to the abutment 7 in the case of tensile stressing. An energy-absorption element 16, which is provided in the region of the abutment 7, is likewise fitted onto the connecting rod 11 and, in the case of the coupling being subjected to tensile stressing, is supported on a metal sheet 17, which is fastened on the abutment 7. As seen in the longitudinal direction of the rail vehicle, from the inside to the outside, the energy-absorption arrangements 10 are therefore designed such that it is the energy-absorption element 16 which is provided first of all, followed by the metal sheet 17 and then the energy-absorption elements 13, 14, which are designed in the form of spring assemblies. The latter are, in turn, supported on the retaining portion 12, which is followed in the outward direction by the energy-absorption element 15, which is secured in a conventional manner by a nut. This design of the energy-absorption arrangements 10 can be gathered, in particular, from FIG. 4. The energy-absorption elements 13, 14, 15, 16 therefore serve, as a whole, to provide for the elastic mounting of the crossmember 4 in relation to the abutment 7, to be precise both in the case of tensile stressing and in the case of compressive stressing. In simplified embodiments, it is possible, if appropriate, just for energy-absorption elements for exclusively compressive stressing or exclusively tensile stressing to be present.

Figure 3:
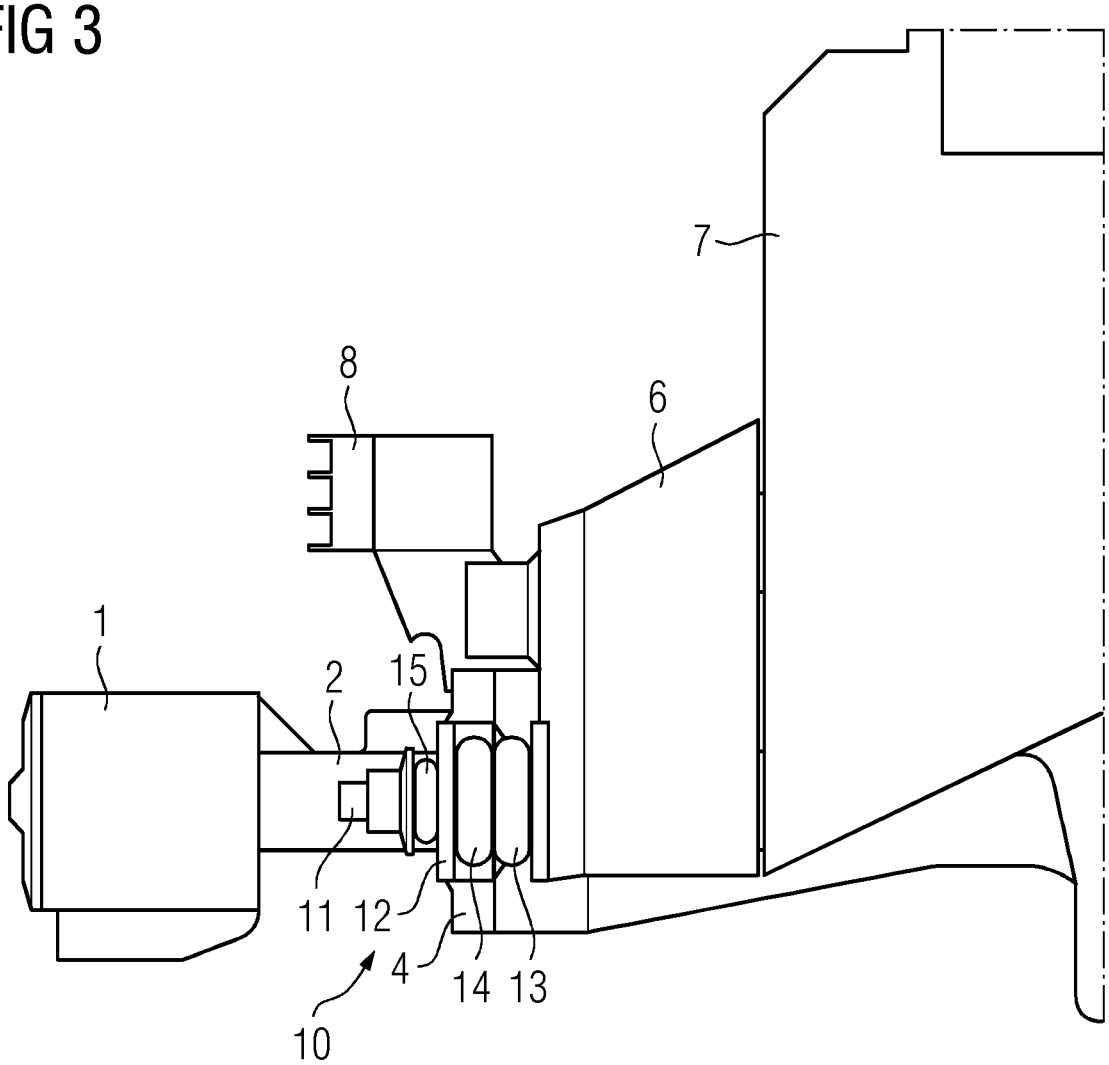
FIG. 3 shows a further vertical cross-sectional view of the coupling region of a rail vehicle from FIG. 1.

FIG. 3 likewise shows the makeup of the energy-absorption arrangement 10.

It can be seen that an energy-absorption arrangement 10 is provided, in a symmetrical state, on either side of the central buffer coupling, each energy-absorption arrangement interacting with an associated abutment 7, on which it is supported.

The invention claimed is:

1. A rail vehicle, comprising:

a rail vehicle body having a front and a front end;

abutments supported on said front end;

a transversely extended crossmember;

at least one elastic energy-absorption configuration connecting said crossmember to one of said abutments;

a coupling disposed centrally in a vicinity of said front and mounted in said crossmember, for introducing forces acting on said coupling through said crossmember and into said abutments; and two connecting rods each being extended in a longitudinal direction of the rail vehicle and being fixed to a respective one of said abutments;

said elastic energy-absorption configurations each being disposed on a respective one of said connecting rods, said elastic energy-absorption configurations each including an energy absorption element, and said respective one of said connecting rods extending through said energy absorption element;

said crossmember having retaining portions with openings formed therein;

said connecting rods each passing through a respective one of said openings; and said elastic energy-absorption configurations being constructed for lateral abutment against said retaining portions.

2. The rail vehicle according to claim 1, wherein said energy-absorption configuration includes energy-absorption elements being disposed and constructed in part for tensile stressing and in part for compressive stressing of said coupling.

3. The rail vehicle according to claim 1, wherein said at least one elastic energy-absorption configuration includes two elastic energy-absorption configurations each being disposed on a respective transverse side of the rail vehicle, in a state in which said elastic energy-absorption configurations are offset horizontally relative to said coupling.

4. The rail vehicle according to claim 1, wherein said crossmember is guided at least one of vertically or laterally relative to said abutments by said connecting rods.

5. The rail vehicle according to claim 1, wherein said crossmember has an inward end portion relative to the rail vehicle, and stops guide said inward end portion on said front of the rail vehicle or said body.

6. The rail vehicle according to claim 1, wherein said abutments are constructed as deformable crumple elements for absorbing collision energy.

7. The rail vehicle according to claim 1, wherein said abutments are interchangeably fastened on said front of the rail vehicle.

8. The rail vehicle according to claim 1, wherein said front of the rail vehicle is constructed as a specifically deformable crumple zone for absorbing collision energy.

9. The rail vehicle according to claim 8, wherein said front of the rail vehicle is interchangeably fastened on said body of the rail vehicle.

10. The rail vehicle according to claim 1, wherein said coupling includes a coupling rod, and energy absorption elements for reversible or irreversible energy absorption or force-limiting are disposed in said coupling rod.

11. The rail vehicle according to claim 1, wherein said coupling includes a coupling rod, and energy absorption elements for reversible or irreversible energy absorption or force-limiting are disposed between said coupling rod and said crossmember.

12. The rail vehicle according to claim 1, which further comprises an anti-climbing device disposed and fastened on said crossmember above said coupling.

* * * * *